US008616186B2

(12) United States Patent
Surnilla et al.

(10) Patent No.: US 8,616,186 B2
(45) Date of Patent: Dec. 31, 2013

(54) EXHAUST GAS RECIRCULATION (EGR) SYSTEM

(75) Inventors: Gopichandra Surnilla, West Bloomfield, MI (US); Daniel Joseph Styles, Canton, MI (US); Mrdjan J. Jankovic, Birmingham, MI (US); Julia Helen Buckland, Commerce Township, MI (US); Amey Y. Karnik, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 57 days.

(21) Appl. No.: 13/176,556

(22) Filed: Jul. 5, 2011

(65) Prior Publication Data

US 2011/0283699 A1 Nov. 24, 2011

(51) Int. Cl.
*F02M 25/07* (2006.01)
*F02B 37/007* (2006.01)

(52) U.S. Cl.
USPC ..... 123/568.11; 60/605.2

(58) Field of Classification Search
USPC ..... 123/568.11, 568.21, 568.22, 568.12; 60/605.2
See application file for complete search history.

(56) References Cited

U.S. PATENT DOCUMENTS

| | | | | |
|---|---|---|---|---|
| 6,871,134 | B2 * | 3/2005 | Lange et al. | 701/108 |
| 7,270,118 | B2 | 9/2007 | Yamaoka et al. | |
| 7,290,528 | B2 * | 11/2007 | Minegishi et al. | 123/399 |
| 7,367,188 | B2 * | 5/2008 | Barbe et al. | 60/605.2 |
| 7,493,762 | B2 * | 2/2009 | Barbe et al. | 60/605.2 |
| 7,526,955 | B2 | 5/2009 | Miyata et al. | |
| 7,681,560 | B2 | 3/2010 | Yamaoka et al. | |
| 7,715,975 | B2 | 5/2010 | Yamaoka et al. | |
| 7,810,476 | B2 * | 10/2010 | Wang et al. | 123/568.16 |
| 2003/0101724 | A1 * | 6/2003 | Zurawski et al. | 60/605.2 |
| 2005/0061304 | A1 * | 3/2005 | Moser et al. | 123/568.2 |
| 2007/0012040 | A1 * | 1/2007 | Nitzke et al. | 60/605.2 |
| 2007/0119172 | A1 * | 5/2007 | Barbe et al. | 60/605.2 |
| 2008/0022677 | A1 * | 1/2008 | Barbe et al. | 60/599 |
| 2008/0051976 | A1 * | 2/2008 | Kimoto et al. | 701/103 |
| 2010/0050999 | A1 * | 3/2010 | Murata et al. | 123/568.11 |
| 2011/0079008 | A1 * | 4/2011 | de Ojeda | 60/602 |
| 2011/0257952 | A1 * | 10/2011 | Motz et al. | 123/568.11 |

* cited by examiner

*Primary Examiner* — Stephen K Cronin
*Assistant Examiner* — Arnold Castro
(74) *Attorney, Agent, or Firm* — Julia Voutyras; Alleman Hall McCoy Russell & Tuttle LLP

(57) ABSTRACT

Various systems and methods are described for an exhaust gas recirculation (EGR) system coupled to an engine in a vehicle. One example method comprises, calculating an EGR mass flow from a difference between measurements of clean air mass flow and total mass flow, and correcting for a transient mass flow error.

14 Claims, 4 Drawing Sheets

EXHAUST GAS RECIRCULATION (EGR) SYSTEM

TECHNICAL FIELD

The present application relates generally to an exhaust gas recirculation system coupled to an engine in a motor vehicle.

BACKGROUND AND SUMMARY

It may be desirable for an engine to include a turbocharger and exhaust gas recirculation (EGR) to reduce emissions of $NO_X$, CO, and other gasses and to improve fuel economy. An EGR system may include a low pressure exhaust gas recirculation (LP-EGR) system, a high pressure exhaust gas recirculation (HP-EGR) system, or both a LP-EGR and a HP-EGR system, for example. The amount of EGR routed through the EGR system is measured and adjusted during engine operation to maintain desirable combustion stability of the engine. One solution for measuring the amount of EGR in the LP-EGR system is for the LP-EGR system to include a mass air flow (MAF) sensor downstream of the hot, moist, exhaust gasses and upstream of the turbocharger compressor. However, the MAF sensor may be exposed to high exhaust temperatures, high concentrations of soot and exhaust hydrocarbons, water condensation, and exhaust pulsations. These conditions may reduce the lifetime of the MAF sensor and reduce its accuracy when measuring the EGR rate. Additionally, a dual bank engine may include two MAF sensors, increasing the engine's cost.

The inventors herein have recognized the above issues and have devised an approach to at least partially address them. For example, the amount of EGR in the LP-EGR system may be resolved by measuring flows at multiple other, cooler and drier locations of the engine intake (e.g., before and after EGR introduction), where the gasses include lower concentrations of soot and exhaust hydrocarbons, and the gasses are less affected by exhaust pulsations.

In one example, a method for controlling an engine is disclosed. Low-pressure EGR is delivered downstream of an intake throttle and upstream of a turbocharger compressor. Further, an operating parameter is adjusted based on an EGR mass flow identified from a difference between a measured clean air mass flow entering the intake throttle and a total mass flow measured downstream from the turbocharger compressor. In this manner, the EGR rate may be measured and maintained at a desirable level while a MAF sensor may be exposed to lower temperatures, lower concentrations of soot and exhaust hydrocarbons, less water condensation, and fewer exhaust pulsations. Thus, the MAF sensor may potentially have a longer lifetime and greater accuracy.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The present description relates to an EGR system coupled to a turbocharged engine in a motor vehicle. In one non-limiting example, the engine may be configured as part of the system illustrated in FIG. 1, wherein the engine includes a turbocharger compressor, an intake throttle upstream of the turbocharger compressor, an intake manifold downstream of the turbocharger compressor, and an EGR system delivering EGR downstream of the intake throttle and upstream of the compressor. The engine may be configured with a plurality of cylinder banks as illustrated in FIG. 2. The systems of FIGS. 1 and 2 may be operated with a method such as the example illustrated in FIG. 3. For example, the method may comprise measuring clean air mass flow entering the intake throttle and measuring a total mass flow downstream from the turbocharger compressor and upstream of the intake manifold. The EGR mass flow may be calculated by subtracting the difference between the total mass flow and the clean air mass flow and correcting for a transient mass flow error. An engine operating parameter may be adjusted based on the EGR mass flow. In this manner, the EGR rate may be measured and maintained at a desirable level while a MAF sensor may be exposed to lower temperatures, lower concentrations of soot and exhaust hydrocarbons, and fewer exhaust pulsations. Additionally, the MAF sensor may be calibrated or diagnosed as illustrated in FIG. 4.

Figure 1:
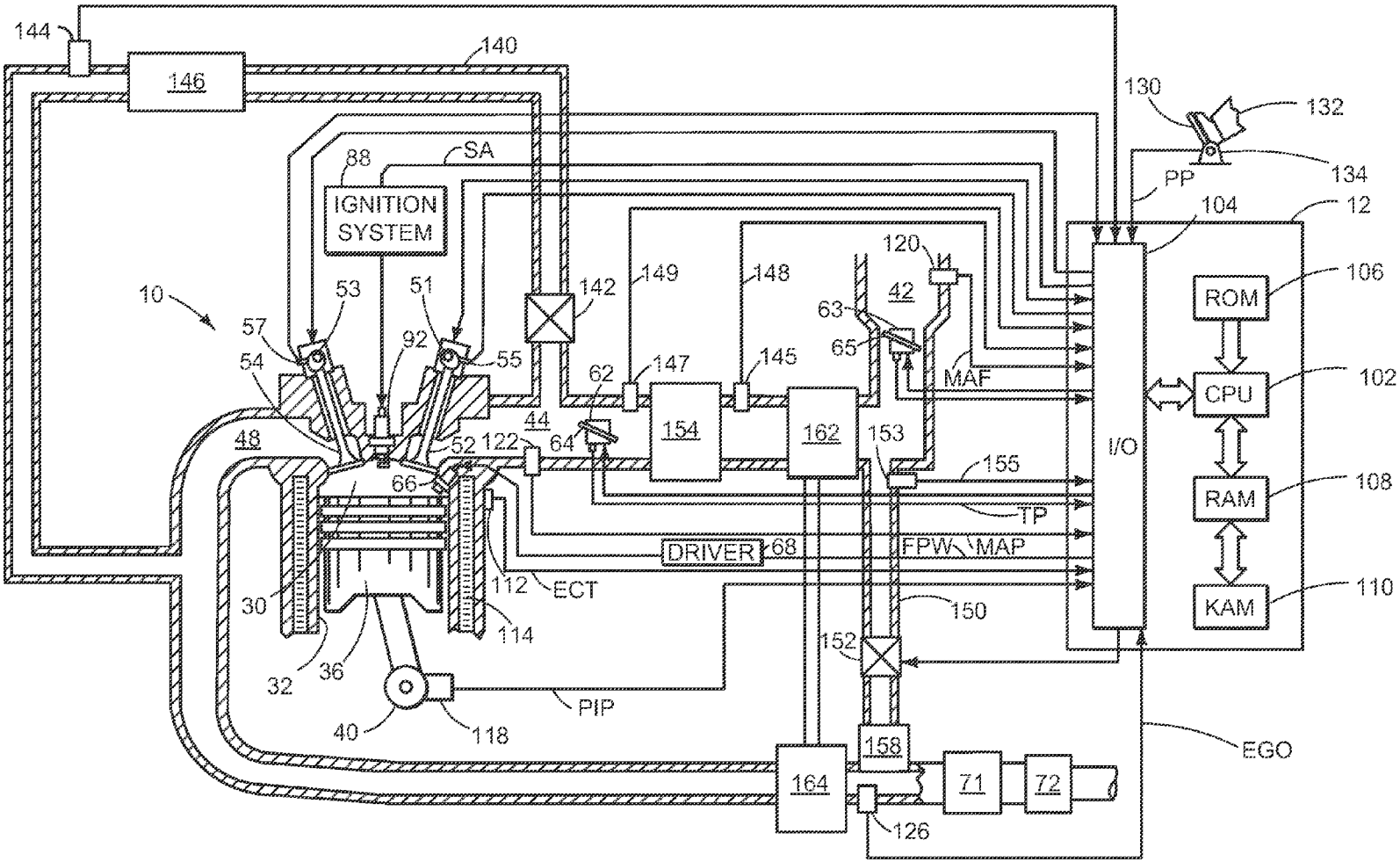
FIG. 1 shows a schematic diagram of an embodiment of an engine with a turbocharger and an exhaust gas recirculation system.
Figure 2:
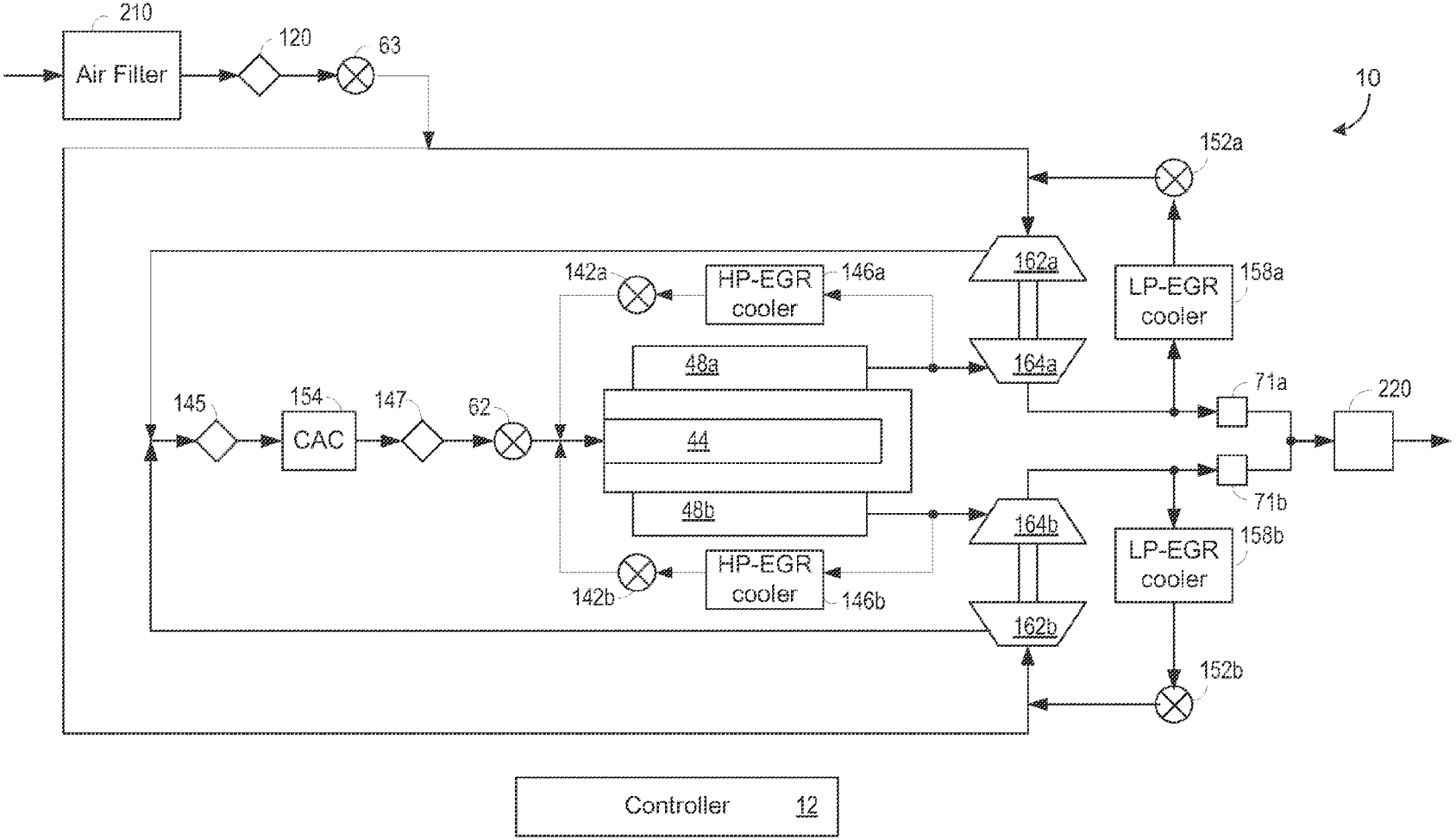
FIG. 2 shows a schematic diagram of an embodiment of an engine with dual cylinder banks, the engine including an exhaust gas recirculation system.

Referring now to FIG. 1, it shows a schematic diagram of one cylinder of multi-cylinder engine 10, which may be included in a propulsion system of an automobile, is shown. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. In some embodiments, the face of piston 36 inside cylinder 30 may have a bowl. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

Intake valve 52 may be controlled by controller 12 via electric valve actuator (EVA) 51. Similarly, exhaust valve 54 may be controlled by controller 12 via EVA 53. Alternatively, the variable valve actuator may be electro hydraulic or any other conceivable mechanism to enable valve actuation. During some conditions, controller 12 may vary the signals provided to actuators 51 and 53 to control the opening and closing of the respective intake and exhaust valves. The position of intake valve 52 and exhaust valve 54 may be determined by valve position sensors 55 and 57, respectively. In alternative embodiments, one or more of the intake and exhaust valves may be actuated by one or more cams, and may utilize one or more of cam profile switching (CPS), variable cam timing (VCT), variable valve timing (VVT) and/or variable valve lift (VVL) systems to vary valve operation. For example, cylinder 30 may alternatively include an intake valve controlled via electric valve actuation and an exhaust valve controlled via cam actuation including CPS and/or VCT.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Intake passage 42 may include throttles 62 and 63 having throttle plates 64 and 65, respectively. In this particular example, the positions of throttle plates 64 and 65 may be varied by controller 12 via signals provided to an electric motor or actuator included with throttles 62 and 63, a configuration that is commonly referred to as electronic throttle control (ETC). In this manner, throttles 62 and 63 may be operated to vary the intake air provided to combustion chamber 30 among other engine cylinders. The positions of throttle plates 64 and 65 may be provided to controller 12 by throttle position signals TP. Pressure, temperature, and mass air flow may be measured at various points along intake passage 42 and intake manifold 44. For example, intake passage 42 may include a mass air flow sensor 120 for measuring clean air mass flow entering through throttle 63. The clean air mass flow may be communicated to controller 12 via the MAF signal.

Engine 10 may further include a compression device such as a turbocharger or supercharger including at least a compressor 162 arranged upstream of intake manifold 44. For a turbocharger, compressor 162 may be at least partially driven by a turbine 164 (e.g., via a shaft) arranged along exhaust passage 48. For a supercharger, compressor 162 may be at least partially driven by the engine and/or an electric machine, and may not include a turbine. Thus, the amount of compression provided to one or more cylinders of the engine via a turbocharger or supercharger may be varied by controller 12. A charge air cooler 154 may be included downstream from compressor 162 and upstream of intake valve 52. Charge air cooler 154 may be configured to cool gasses that have been heated by compression via compressor 162, for example. In one embodiment, charge air cooler 154 may be upstream of throttle 62. Pressure, temperature, and mass air flow may be measured downstream of compressor 162, such as with sensor 145 or 147. The measured results may be communicated to controller 12 from sensors 145 and 147 via signals 148 and 149, respectively. Pressure and temperature may be measured upstream of compressor 162, such as with sensor 153, and communicated to controller 12 via signal 155.

Further, in the disclosed embodiments, an EGR system may route a desired portion of exhaust gas from exhaust passage 48 to intake manifold 44. FIG. 1 shows a HP-EGR system and a LP-EGR system, but an alternative embodiment may include only a LP-EGR system. The HP-EGR is routed through HP-EGR passage 140 from upstream of turbine 164 to downstream of compressor 162. The amount of HP-EGR provided to intake manifold 44 may be varied by controller 12 via HP-EGR valve 142. The LP-EGR is routed through LP-EGR passage 150 from downstream of turbine 164 to upstream of compressor 162. The amount of LP-EGR provided to intake manifold 44 may be varied by controller 12 via LP-EGR valve 152. The HP-EGR system may include HP-EGR cooler 146 and the LP-EGR system may include LP-EGR cooler 158 to reject heat from the EGR gasses to engine coolant, for example.

Under some conditions, the EGR system may be used to regulate the temperature of the air and fuel mixture within combustion chamber 30. Thus, it may be desirable to measure or estimate the EGR mass flow. An EGR sensor may be arranged within an EGR passage and may provide an indication of one or more of mass flow, pressure, temperature, concentration of $O_2$, and concentration of the exhaust gas. For example, an HP-EGR sensor 144 may be arranged within HP-EGR passage 140. Alternatively and as further elaborated herein, the EGR mass flow may be estimated from a measurement of the clean air mass flow and a measurement of a combination of the clean air mass flow and the exhaust gas mass flow. For example, the clean air mass flow may be measured by sensor 120 and a combination of the clean air mass flow and the low pressure exhaust gas mass flow may be measured by a MAF sensor, such as sensor 145 or sensor 147. At one engine operating condition, the exhaust gas mass flow may be estimated from only measurements of a clean air mass flow and a combination of the clean air mass flow and the exhaust gas mass flow, such as by subtracting the clean air mass flow from the combination of the clean air mass flow and the exhaust gas mass flow, for example.

Exhaust gas sensor 126 is shown coupled to exhaust passage 48 upstream of emission control system 70 and downstream of turbine 164. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_X$, HC, or CO sensor.

Emission control devices 71 and 72 are shown arranged along exhaust passage 48 downstream of exhaust gas sensor 126. Devices 71 and 72 may be a selective catalytic reduction (SCR) system, three way catalyst (TWC), $NO_X$ trap, various other emission control devices, or combinations thereof. For example, device 71 may be a TWC and device 72 may be a particulate filter (PF). In some embodiments, PF 72 may be located downstream of TWC 71 (as shown in FIG. 1), while in other embodiments, PF 72 may be positioned upstream of TWC 72 (not shown in FIG. 1). Further, in some embodiments, during operation of engine 10, emission control devices 71 and 72 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Storage medium read-only memory 106 can be programmed with computer readable data representing instructions executable by processor 102 for performing the methods described below as well as other variants that are anticipated but not specifically listed.

As described above, FIG. 1 shows only one cylinder of a multi-cylinder engine, and that each cylinder may similarly include its own set of intake/exhaust valves, fuel injector, spark plug, etc. In FIG. 2, an example of an engine system including a plurality of cylinder banks and an exhaust gas recirculation system is illustrated. In one embodiment, engine 10 may comprise a turbocharger including compressor 162 and turbine 164, throttle 63 upstream of compressor 162, and a low-pressure exhaust gas recirculation (LP-EGR) system. The LP-EGR system may route EGR from downstream of turbine 164 to upstream of compressor 162 and downstream of throttle 63. The engine system may further comprise mass flow sensor 120 upstream of throttle 63, throttle 62 downstream of compressor 162, and a second mass flow sensor downstream of compressor 162 and upstream of throttle 62.

Turning to FIG. 2, air may enter engine 10 through an air filter 210. Air filter 210 may be configured to remove solid particulates from the air so a clean air mass may enter engine 10. The clean air mass flow may be measured as it flows past mass air flow sensor 120 and then through intake throttle 63. The clean air mass flow measured by mass air flow sensor 120 may be communicated to controller 12. In one embodiment, the clean air mass may be split between the different cylinder banks of engine 10 downstream of intake throttle 63 and upstream of turbocharger compressor 162. An EGR system may inject exhaust gas upstream of turbocharger compressor 162 so that a combination of clean air and exhaust gas can be compressed by turbocharger compressor 162. In one embodiment, turbocharger compressor 162 may include a first compressor 162*a* for a first cylinder bank and a second compressor 162*b* for a second cylinder bank. As the hot, moist, exhaust gas mixes with the cooler and drier clean air, the combination of clean air and exhaust gas may be cooler and drier than the exhaust gas. Similarly, the soot and exhaust hydrocarbons in the exhaust gas may be diluted in the combination of clean air and exhaust gas. Similarly, pressure pulsations in the exhaust gas may be dampened in the combination of clean air and exhaust gas.

The compressed combination of clean air and exhaust gas downstream of turbocharger compressor 162 may be cooled by a charge air cooler (CAC) 154 upstream of a second throttle 62. In one embodiment, the air mass flow downstream from turbocharger compressor 162 may be measured by a sensor 145 upstream of CAC 154. Pressure and temperature may be measured by sensor 145. In an alternate embodiment, the air mass flow downstream from turbocharger compressor 162 may be measured by a sensor 147 downstream of CAC 154. Pressure and temperature may be measured by sensor 147. Measurements from sensors 145 and 147 may be communicated to controller 12. The combination of clean air and exhaust gas may be drier upstream of CAC 154, so sensor 145 may be exposed to less water condensation than sensor 147.

In one embodiment, high pressure exhaust gas may be combined with the compressed combination of clean air and exhaust gas downstream of throttle 62 and upstream of intake manifold 44. The combination of gasses may be routed to one or more cylinder banks by intake manifold 44. After combustion in the cylinders, exhaust gas may be routed through exhaust passage 48. In one embodiment, exhaust passage 48 includes an exhaust manifold for each bank of cylinders, such as exhaust manifold 48*a* for a first cylinder bank and exhaust manifold 48*b* for a second cylinder bank.

At least a portion of the exhaust gasses may drive a turbine 164 of the turbocharger. In one embodiment, turbine 164 may include a first turbine 164*a* for a first cylinder bank and a second turbine 164*a* for a second cylinder bank. In one embodiment, at least a portion the exhaust gasses may be routed through a HP-EGR system. For example, a HP-EGR system may include HP-EGR cooler 146 and valve 142 for routing cooled exhaust gasses upstream of intake manifold 44. In one embodiment, a HP-EGR system may include a first HP-EGR cooler 146*a* and valve 142*a* for a first cylinder bank and a second HP-EGR cooler 146*a* and valve 142*a* for a second cylinder bank.

Downstream from turbine 164, at least a portion of the exhaust gasses may flow downstream through emission control device 71 and muffler 220. In one embodiment, emission control device 71 may include a first light-off catalyst 71*a* for a first cylinder bank and a second light-off catalyst 71*a* for a second cylinder bank. Muffler 220 may be configured to dampen exhaust noise from engine 10. Muffler 220 may also generate exhaust backpressure as the flow of exhaust gas is restricted when returning to the atmosphere.

At least a portion of the exhaust gasses from downstream of turbine 164 may be routed upstream of turbocharger compressor 162 by a LP-EGR system. For example, a LP-EGR system may include LP-EGR cooler 158 and valve 152 for routing cooled exhaust gasses upstream of compressor 162. In one embodiment, a LP-EGR system may include a first LP-EGR cooler 158*a* and valve 152*a* for a first cylinder bank and a second LP-EGR cooler 158*a* and valve 152*a* for a second cylinder bank. To maintain stable combustion of engine 10, it may be desirable to know the amount of exhaust gas routed through the LP-EGR system, also known as the amount of LP-EGR, or the amount of EGR. One solution for measuring the amount of EGR in the LP-EGR system is for the LP-EGR system to include a mass air flow (MAF) sensor downstream of the hot exhaust gasses and upstream of the turbocharger compressor. For example, MAF sensors can be located downstream of EGR valves 152*a* and 152*b*.

However, even cooled exhaust gasses may be hot enough to potentially reduce the lifetime of a MAF sensor. Further, the exhaust gasses downstream of LP-EGR cooler 158 may include condensed water that may reduce the lifetime and accuracy of a MAF sensor. High concentrations of soot and exhaust hydrocarbons downstream of exhaust passage 48 may reduce the lifetime and accuracy of a MAF sensor. Pressure fluctuations downstream of exhaust passage 48 may reduce the accuracy of a MAF sensor. Thus, it may be desirable to estimate the amount of LP-EGR from a measurement at a cooler part of the engine, where the gasses are cooler and include lower concentrations of water, soot, and exhaust hydrocarbons, and the gasses are less affected by exhaust pulsations.

Figure 3:
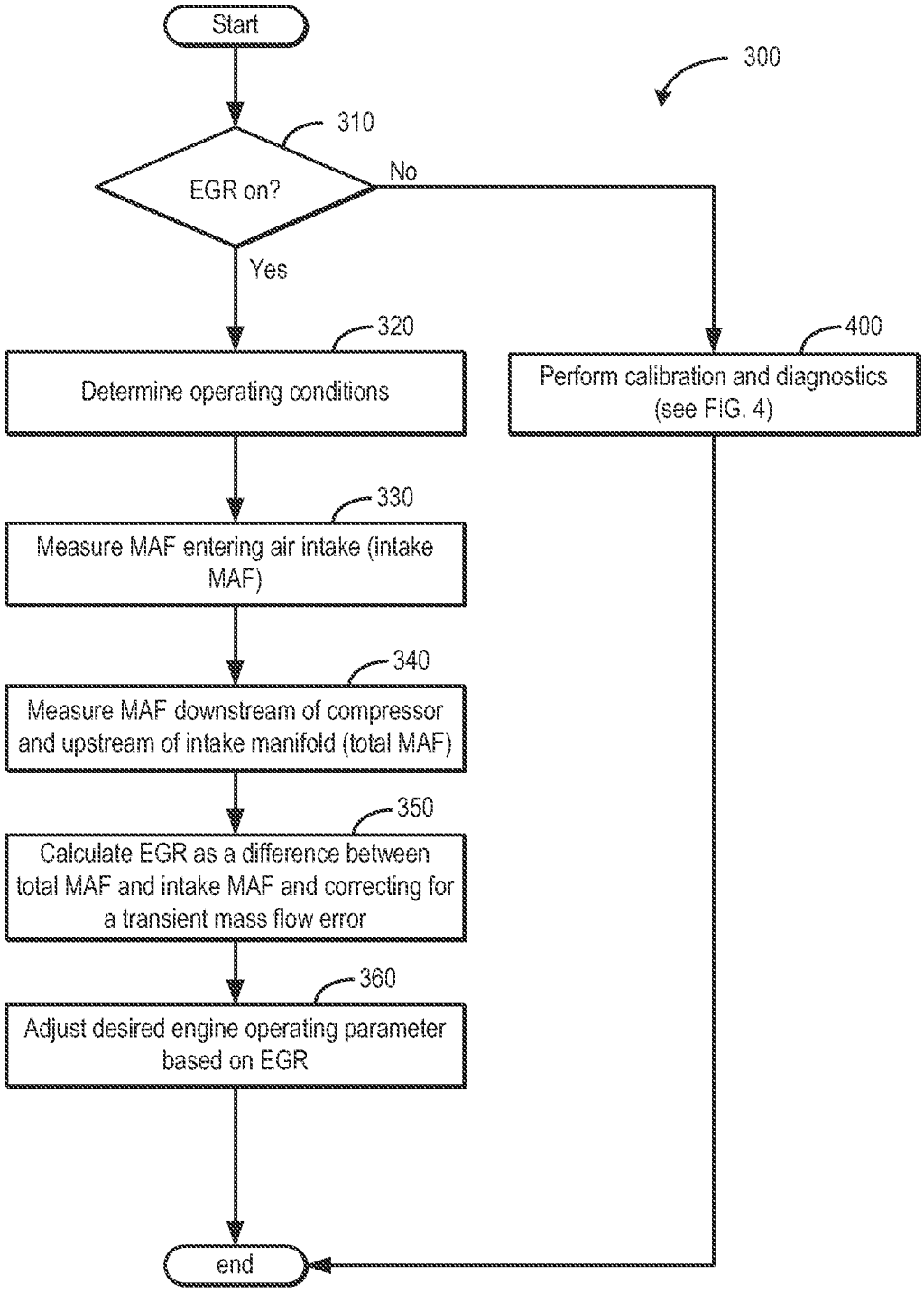
FIG. 3 shows a flow chart of an example exhaust gas recirculation system control method.
Figure 4:
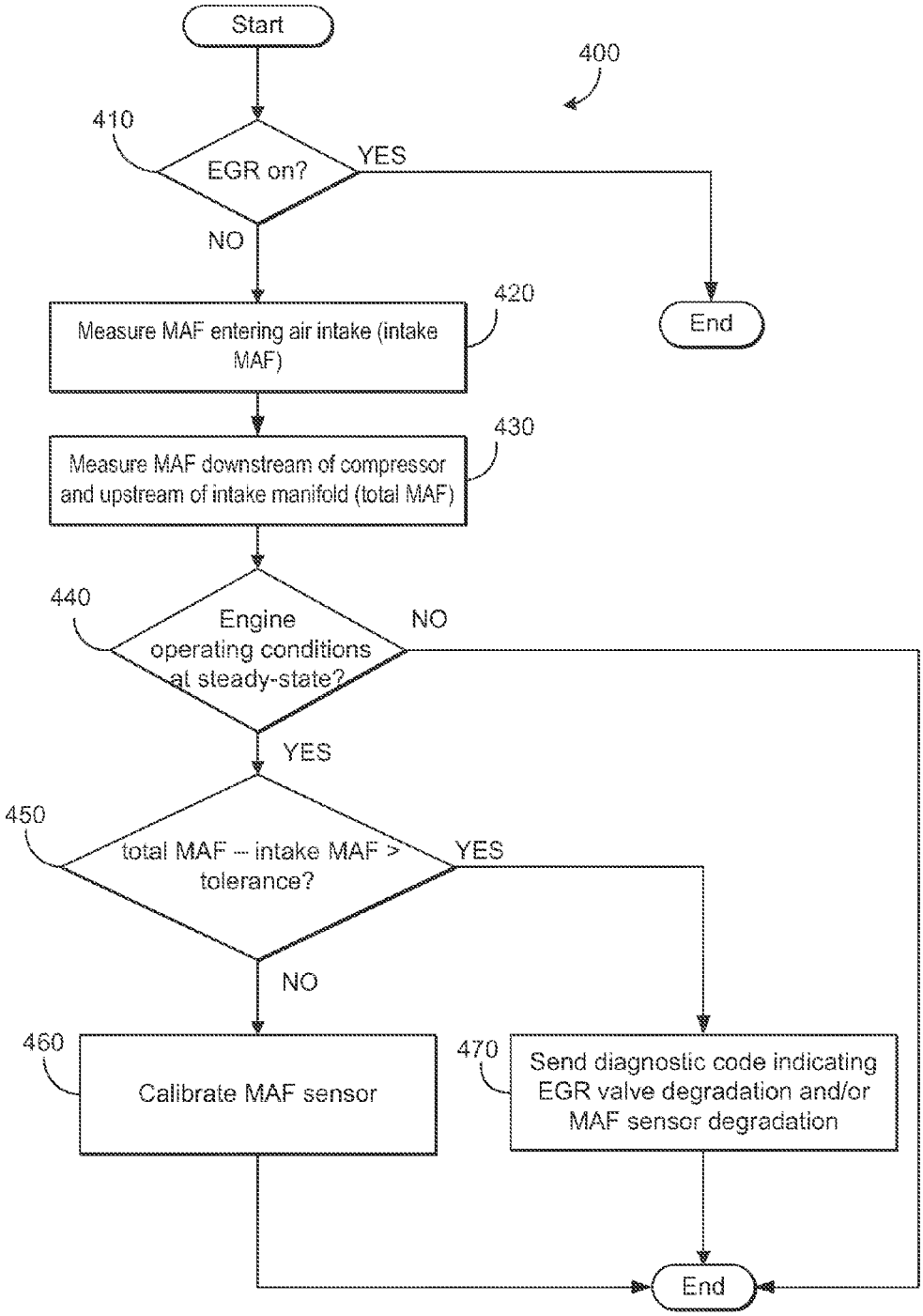
FIG. 4 shows a flow chart of an embodiment of a control routine for calibration and diagnostics of a MAF sensor.

For example, and as further elaborated in FIG. 3, a method 300 may be executed by an engine controller, such as 12, for controlling an engine 10. Engine 10 includes a turbocharger compressor 162, an intake throttle 63 upstream of turbocharger compressor 162, an intake manifold 44 downstream of the turbocharger compressor 162, and an EGR system injecting EGR downstream of intake throttle 63 and upstream of compressor 162. Clean air mass flow may be measured entering intake throttle 63. A total mass flow may be measured downstream from turbocharger compressor 162 and upstream of intake manifold 44. An EGR mass flow may be identified by a difference between the total mass flow and the clean air mass flow. The difference may be corrected for a transient mass flow error. An operating parameter of engine 10 may be adjusted based on the EGR mass flow.

Continuing with FIG. 3, at 310, it may be determined if the EGR system is switched on. If the EGR system is switched on, method 300 may be used to estimate the amount of EGR and an engine operating parameter may be adjusted based on the amount of EGR. If the EGR system is switched off, a MAF sensor may be calibrated as further elaborated in FIG. 4. If the EGR system is switched on, method 300 may continue at 320. Otherwise, method 300 continues at 400.

At 320, a set of engine operating conditions may be determined. For example, the set of engine operating conditions may include conditions related to the amount of EGR for desirable combustion. For example, the engine coolant temperature may be measured by temperature sensor 112. The air charge temperature may be measured by a sensor, such as sensor 147. The engine speed may be measured by sensor 118. The engine load may be calculated from engine parameters derived from various combinations of sensors, such as MAF sensor 120 or MAP sensor 122.

As another example, the set of engine operating conditions may include conditions for determining if engine 10 is operating in a steady-state or a transient condition. For example, pedal position sensor 134 may generate a proportional pedal position signal that can be monitored for changes within a predetermined time interval to potentially indicate a transient condition of engine 10. The engine speed and load may be monitored for changes within a predetermined time interval to potentially indicate a transient condition of engine 10. As another example, a transient condition of engine 10 may include acceleration and deceleration of the turbocharger.

As another example, the set of engine operating conditions may include pressure and temperature at various points along the flow of gasses to and from engine 10. The pressure and temperature at each point may be measured, estimated, or calculated depending on the presence or absence of a sensor at the point of interest. For example, pressure and temperature may be measured upstream of compressor 162, downstream of compressor 162 and upstream of CAC 154, downstream of CAC 154 and upstream of throttle 62, and downstream of valve 152.

At 330, the mass air flow may be measured upstream of throttle 63. In one embodiment, the mass air flow may be measured upstream of throttle 63 and downstream of air filter 210. In this manner, the clean air mass flow (intake MAF) entering engine 10 may be measured.

At 340, the mass air flow may be measured downstream of compressor 162 and upstream of intake manifold 44. In one embodiment, the mass air flow may be measured downstream of compressor 162 and upstream of CAC 154, such as by sensor 145. In an alternate embodiment, the mass air flow may be measured downstream of CAC 154 and upstream of throttle 62, such as by sensor 147. In yet another alternate embodiment, the air mass flow may be estimated by a speed-density method, such as based on calibrated data and manifold pressure and engine speed utilizing engine breathing mapping. For example, the air mass flow entering engine 10 may be estimated from the MAP, air charge temperature, throttle position, and engine speed. In this manner, the air mass flow of the combination of clean air and low pressure exhaust gas (total MAF) entering engine 10 may be measured.

At 350, an EGR mass flow may be calculated. In one embodiment, the EGR mass flow may be estimated as the difference between the total MAF and the intake MAF corrected for transient mass flow error. During one or more operating points of engine 10, such as during a steady-state condition of engine 10, the EGR mass flow injected by the LP-EGR system may be estimated as the difference between the total MAF and the intake MAF. Thus, the exhaust gas mass flow may be estimated at a predefined engine operating point using only a measurement of the clean air mass flow, such as from sensor 120, and a measurement of a combination of the clean air mass flow and the exhaust gas mass flow, such as from sensor 145.

However, during a different operating point of engine 10, such as during a transient condition of engine 10, it may be desirable to compensate for a transient mass flow error. For example, the EGR mass flow injected by the LP-EGR system may be estimated as the difference between the total MAF and the intake MAF, corrected for the transient mass flow error during a transient condition of engine 10. The transient mass flow error may include a transport delay term and a pressure change term.

The transport delay term may account for a transport delay between the location of an EGR valve and the location of the sensor measuring total MAF. In one embodiment, the transport delay may account for the distance along air passages between valve 152 and sensor 145. In an alternate embodiment, the transport delay may account for the distance along air passages between valve 152 and sensor 147. Pressure waves propagate at the speed of sound and so the transport delay may be calculated as the speed of sound multiplied by the distance between the EGR valve and the location of the sensor measuring total MAF.

The pressure change term may account for an error due to a pressure change between the location of an EGR valve and the location of the sensor measuring total MAF. For example, during a transient pressure change between the location of the EGR valve and the location of the sensor measuring total MAF, mass may be contributed to the pressure change. For example, when pressure rises at valve 152, sensor 145 may measure less total MAF than would be expected for the pressure at valve 152. Thus, the pressure change term may increase as pressure increases at valve 152. Similarly, when pressure falls at valve 152, sensor 145 may measure more total MAF than would be expected for the pressure at valve 152. Thus, the pressure change term may decrease as pressure decreases at valve 152.

In one embodiment, the pressure change term may be derived from the ideal gas law, $PV=mRT$, which can be rewritten as $m=PV/RT$. The change in mass between a first location and a second location may be $(m2-m1)=V/R*(P2/T2-P1/$ T1). Thus, measurements of pressure and temperature at the EGR valve and at the location of the sensor measuring total MAF may be used to calculate the pressure change term. In an alternative embodiment, the pressure and temperature at the EGR valve and at the location of the sensor measuring total MAF may be estimated from other parameters and then used to calculate the pressure change term.

At 360, an engine operating parameter may be adjusted based on the EGR mass flow estimated at 350. For example, the EGR mass flow may be adjusted based on the EGR mass flow, such as by adjusting valve 152. As another example, a timing parameter of a VCT system may be adjusted based on the EGR mass flow. In yet another example, the throttle position of throttles 62 or 63 may be adjusted based on the EGR mass flow.

Thus, an engine operating parameter may be adjusted according to an estimated amount of EGR routed through a LP-EGR system. The amount of EGR may be estimated from measurements of the clean air mass flow and the combination of clean air and low pressure exhaust gas mass flow. The LP-EGR system may be switched off during one or more operating conditions so that the LP-EGR system is not injecting exhaust gas upstream of compressor 162. Thus, the clean air mass flow may equal the air mass flow of the combination of clean air and low pressure exhaust gas when the LP-EGR system is switched off. In one embodiment, one or more mass flow sensors may be calibrated when the LP-EGR system is switched off. FIG. 4 shows a flow chart of an embodiment of a method 400 for calibration and diagnostics of a MAF sensor. Method 400 may be executed by an engine controller, such as 12, for controlling an engine 10.

Turning to FIG. 4, at 410, it may be determined if the EGR system is switched on. If the EGR system is not switched on, e.g. the EGR system is off, method 400 may be used to calibrate a mass flow sensor. In one embodiment, the EGR system may be off when valve 152 is closed. If the EGR system is switched on, method 400 may end. If the EGR system is switched off, method 400 may continue at 420.

At 420, the mass air flow may be measured upstream of throttle 63. In one embodiment, the mass air flow may be measured upstream of throttle 63 and downstream of air filter 210. In this manner, the clean air mass flow (intake MAF) entering engine 10 may be measured.

At 430, the mass air flow may be measured downstream of compressor 162 and upstream of intake manifold 44. In one embodiment, the mass air flow may be measured downstream of compressor 162 and upstream of CAC 154, such as by sensor 145. In an alternate embodiment, the mass air flow may be measured downstream of CAC 154 and upstream of throttle 62, such as by sensor 147. In this manner, the air mass flow of the combination of clean air and low pressure exhaust gas (total MAF) entering engine 10 may be measured.

At 440, it is determined if engine 10 is operating in a steady-state condition. For example, engine 10 may be operating in a steady-state condition if the engine speed and load are vary less than a threshold amount over a predetermined time interval. As another example, engine 10 may be operating in a steady-state condition if the measured clean air mass flow varies by less than a threshold amount over a predetermined time interval. In one embodiment, if engine 10 is not operating in steady-state, method 400 may end. If engine 10 is operating in steady-state, method 400 may continue at 450.

When the EGR system is switched off and engine 10 is operating in steady-state, the total MAF may be substantially the same as the clean air mass flow. Thus, the measurement of the intake MAF from sensor 120 and the measurement of the total MAF from a sensor, such as sensor 145, may be substantially the same. However, the sensors may not track each other over different engine operating conditions or characteristics of the sensors may change over the lifetime of the sensors. Thus, it may be desirable to calibrate one or more of the sensors so that each of the sensors record substantially the same measurement for substantially the same air mass flow. However, sometimes a sensor may fail and the measurement from the sensor may be erroneous. It may be desirable to detect when a sensor fails.

At 450, the total MAF measured at 430 is subtracted from the intake MAF measured at 420 to generate a difference of the measurements. If the difference of the measurements is within a tolerance threshold, then the sensors measuring the total MAF and the intake MAF may be operating correctly, and method 400 may continue at 460. However, if the difference of the measurements is greater than the tolerance threshold, a failure may have occurred and method 400 may continue at 470.

At 460, one or more sensors may be calibrated. For example, one or more of sensors 120, 145, and 147 may be calibrated. In one embodiment, sensor 145 may be calibrated if the difference of the measurements from sensors 120 and 145 is greater than a calibration threshold. In an alternate embodiment, sensor 147 may be calibrated if the difference of the measurements from sensors 120 and 147 is greater than a calibration threshold. Method 400 may end after calibration is complete.

At 470, a failure may have occurred. For example, one or more of sensors 120, 145, and 147 may have failed. Further, an EGR valve, such as valve 152, may have degraded causing the total MAF to be substantially different than the intake MAF. For example, if valve 152 does not fully close when in the closed position, the total MAF may be greater than the intake MAF because exhaust gas may be injected upstream of compressor 162. It may be difficult to discern whether the EGR valve or one of the sensors has failed and so, in one embodiment, a diagnostic code may be sent to controller 12 indicating that the EGR valve or the sensor has failed. In another example, a sensors may fail and send a signal that is out of range, such as a voltage that exceeds a threshold. In one embodiment, a diagnostic code may be sent to controller 12 indicating that the sensor has failed when a voltage threshold is exceeded. The method may end after 470.

In this way, an amount of EGR in an LP-EGR system may be calculated by measuring mass air flow at parts of the engine cooler than at the output of the EGR valve, at a location where the gasses include lower concentrations of soot and exhaust hydrocarbons, and where the gasses are less affected by exhaust pulsations Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. An engine control method, comprising:

delivering low-pressure exhaust gas recirculation (EGR) to downstream of an intake throttle and upstream of a turbocharger compressor; and adjusting an operating parameter based on EGR mass flow identified from a difference between a measured clean air mass flow entering the intake throttle and a total mass flow measured and indicated by a mass air flow sensor positioned downstream from the turbocharger compressor and upstream of a charge air cooler, the turbocharger compressor being a first turbocharger compressor for a first cylinder bank, and the total mass flow being measured downstream from a junction of the first turbocharger compressor and a second turbocharger compressor for a second cylinder bank.

2. The method of claim 1, wherein the difference is corrected based on transient pressure variations.

3. The method of claim 1, wherein the difference is corrected based on a rate of change in pressure and temperature upstream and downstream of the turbocharger compressor.

4. The method of claim 1, wherein the difference is corrected based on a change in pressure and temperature of an accelerating or decelerating turbocharger compressor.

5. The method of claim 1, wherein the difference is corrected based on a transport delay correction.

6. The method of claim 1, wherein adjusting the engine operating parameter includes adjusting an EGR control valve, the method further comprising updating a calibration during operation of the mass flow sensor when an EGR control valve is closed.

7. A system for an engine in a vehicle, comprising:

a turbocharger including a first compressor and a turbine;

a first throttle upstream of the compressor;

a first mass flow sensor upstream of the first throttle;

a low-pressure exhaust gas recirculation (LP-EGR) system, the LP-EGR system routing LP-EGR from downstream of the turbine to upstream of the compressor and downstream of the first throttle;

a second throttle downstream of the compressor;

a charge air cooler downstream of the compressor; and a second mass flow sensor positioned downstream of the compressor, upstream of the charge air cooler, upstream of the second throttle, and downstream from a junction of the first compressor and a second compressor of a second turbocharger.

8. The system of claim 7, further comprising:

a high-pressure exhaust gas recirculation (HP-EGR) system, the HP-EGR system routing HP-EGR from upstream of the turbine to downstream of the second throttle.

9. The system of claim 7, wherein the charge air cooler is upstream of the second throttle.

10. The system of claim 7, further comprising:

a control system comprising a computer readable storage medium, the medium comprising instructions for:

measuring a first mass flow from the first mass flow sensor;

measuring a second mass flow from the second mass flow sensor;

calculating an EGR mass flow according to the first mass flow, the second mass flow, and a correction term; and adjusting an engine operating parameter based on the EGR mass flow.

11. The system of claim 10, wherein the engine operating parameter is adjusted by adjusting a valve of the LP-EGR system.

12. The system of claim 10, comprising a variable cam timing system and wherein the engine operating parameter is adjusted by adjusting a timing parameter of the variable cam timing system.

13. The system of claim 10, wherein the engine operating parameter is adjusted by adjusting at least one of the first throttle and the second throttle.

14. The system of claim 10, wherein the medium further comprises instructions for calibrating the second mass flow sensor when a valve of the LP-EGR system is closed.

* * * * *